US006370730B1

(12) United States Patent
Young et al.

(10) Patent No.: US 6,370,730 B1
(45) Date of Patent: Apr. 16, 2002

(54) HOSE LOCK WITH INTEGRAL SEAL

(75) Inventors: Jeffrey L. Young, Saint Peters; Michael F. Martin, Saint Charles; Stuart V. Holsten, O'Fallon, all of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/422,480

(22) Filed: Oct. 21, 1999

Related U.S. Application Data

(63) Continuation-in-part of application No. 09/141,545, filed on Aug. 28, 1998, now Pat. No. 6,115,881.

(51) Int. Cl.[7] ..... A47L 9/24
(52) U.S. Cl. ..... 15/327.1; 285/7
(58) Field of Search ..... 15/327.1, 377; 285/7

(56) References Cited

U.S. PATENT DOCUMENTS

| | | | | | |
|---|---|---|---|---|---|
| 2,198,905 | A | * | 4/1940 | Content | 285/7 |
| 2,461,024 | A | * | 2/1949 | Baumgardner | 285/7 |
| 2,755,106 | A | * | 7/1956 | Brennan et al. | 285/7 |
| 2,839,316 | A | * | 6/1958 | Kasper | 285/7 |
| 2,912,261 | A | * | 11/1959 | Meyerhoefer | 285/7 |
| 2,951,714 | A | * | 9/1960 | Carlberg | 285/7 |
| 3,073,626 | A | * | 1/1963 | Gasparini | 285/7 |
| 3,149,362 | A | * | 9/1964 | Smithson | 15/327.1 |
| 3,870,491 | A | * | 3/1975 | Friesen et al. | 15/351 X |
| 4,017,937 | A | * | 4/1977 | Hanold | 15/327.1 |
| 4,669,755 | A | * | 6/1987 | Harris et al. | 285/7 |
| 4,941,689 | A | * | 7/1990 | Sjoberg | 285/7 |
| 4,964,189 | A | * | 10/1990 | Rau et al. | 15/327.6 |
| 5,568,946 | A | * | 10/1996 | Jackowski | 285/7 |

* cited by examiner

*Primary Examiner*—Chris K. Moore
(74) *Attorney, Agent, or Firm*—Howrey Simon Arnold & White, LLP

(57) ABSTRACT

A device for connecting a hose to an article, such as a wet/dry vacuum, includes a first member having first and second ends, with the first end adapted to be coupled to the hose. A receptacle has first and second ends. The first end of the receptacle is adapted to be mounted to the article, and the second end is adapted to be connected to the second end of the first member. A locking member is mounted on one of the first member or the receptacle for securing the first member to the receptacle, and at least one sealing member is situated about one of the second end of the first member or the second end of the receptacle. This sealing member can be integrally mounted to one of the ends. In one embodiment, the sealing member seals against an external surface of the receptacle, and in an alternative embodiment, the sealing member seals against an internal surface of the receptacle.

12 Claims, 10 Drawing Sheets

HOSE LOCK WITH INTEGRAL SEAL

RELATED CASE

This is a continuation in part of application Ser. No. 09/141,545, filed on Aug. 28, 1998 now U.S. Pat. No. 6,115,881.

BACKGROUND OF THE INVENTION

1. Field of the Invention

The present invention relates generally to hose locks, and more particularly to hose locks for wet/dry vacuum cleaners requiring a sealed connection to prevent leakage.

2. Description of Related Art

Vacuum appliances capable of picking up both wet and dry material, commonly referred to as wet/dry vacuums or wet/dry vacs, are often used in workshops and other environments where both wet and dry debris can accumulate. Wet/dry vacs conventionally consist of a collection tank or canister, sometimes mounted on wheels or casters, and a powerhead within which a motor and impeller assembly is mounted. The motor and impeller assembly creates suction within the canister, such that debris and/or liquid is drawn in to the canister through an air inlet to which a flexible hose can be attached. A filter within the canister prevents incoming debris from escaping from the canister while allowing filtered air to escape. Any liquid drawn into the canister is diffused and accumulates on the bottom of the canister.

With known wet/dry vacs, the hose is typically attached to the air inlet via a friction fit. Ordinarily, the connection end of the hose is tapered, and the tapered end is simply inserted into the air inlet until the two parts mate. The friction between the hose and the air inlet is relied upon to hold the hose in place. It is important to have a sealed connection between the hose and the air inlet, because any air leaks thereabout reduce the suction through the hose, degrading performance. Unfortunately, Wet/dry vacs employing a hose connection using a purely friction fit often have problems with the hose connection leaking, or inadvertently disconnecting.

One common attempted remedy for this problem is to insert the end of the hose into the air inlet forcefully, such that the hose end is mated very tightly with the air inlet. However, this type of connection is often unsatisfactory for users, since it is difficult to discern whether the connection is tight enough to prevent leaks and disconnections. Further, if the hose end is mated with the air inlet tightly enough to provide a sealed connection and prevent inadvertent disconnections, the hose often becomes difficult to remove.

Another attempted solution uses a locking member to positively couple the hose to the air inlet. This is also not without problems. With purely friction fit, manufacturing tolerances for the tapered hose end are typically relaxed, since the tapered end is inserted until it mates with the air inlet. However, if a locking member is added to lock the hose to the air inlet, manufacturing tolerances become significantly more critical. If placement of the locking member is off in one direction, the tapered end of the hose may not mate with the air inlet when the lock is engaged. On the other hand, if placement of the locking member is off in the opposite direction, friction between the tapered end of the hose and the air inlet may prevent inserting the hose end far enough to allow the locking member to engage. Tightening tolerances such that the tapered hose end mates with the air inlet in a sealed manner, while allowing the locking member to positively lock the hose in place can significantly increase design and manufacturing costs.

Thus, there remains a need for a hose lock that is quick and easy to lock and unlock with a secure connection that prevents leakage. The present invention provides for a hose lock that addresses shortcomings associated with the prior art.

SUMMARY OF THE INVENTION

In one aspect of the present invention, a device for connecting a hose to a wet/dry vacuum includes a first member having first and second ends, with the first end adapted to be coupled to the hose. A receptacle has first and second ends. The first end of the receptacle is adapted to be mounted to the article, and the second end is adapted to be connected to the second end of the first member. A locking member is mounted on one of the first member or the receptacle for securing the first member to the receptacle, and at least one sealing member is situated about one of the second end of the first member or the second end of the receptacle. In one embodiment, the sealing member is integrally formed with the first member and is adapted to seal against an external surface of the receptacle. In another embodiment, the sealing member comprises a sealing ring removably mounted on the first member or the receptacle.

An alternative embodiment of this invention is an adapter for adapting a friction-based vacuum connection receptacle, as disclosed in the prior art, such that that it can be used with the hose-locking mechanism of this invention. The adapter has first and second ends. A first end is constructed such that the adapter can be affixed to the friction-based connecting receptacle of a vacuum. A second end of the adapter is constructed so as to be able to connect to a first member, (such as on the end of a hose) having a locking member, as described above.

In another aspect of the present invention a wet/dry vac includes a collection tub, a lid coupled to the collection tub and a powerhead assembly operable to create suction within the collection tub. An inlet port is disposed in one of the lid or the collection tub and a receptacle is coupled to the inlet port. A connection member has first and second ends, with the first end adapted to be coupled to the hose. At least one sealing member is mounted on at least one of the receptacle and the first end of the connection member. The sealing member may be integrally formed with the receptacle or the connection member, or the sealing member may comprise a sealing ring that is removably mounted to the connection member or the receptacle. A locking member is provided for securing the connection member to the receptacle member. In one embodiment, the sealing member seals with an external surface of the receptacle. In another embodiment, the sealing member seals with an internal surface of the receptacle in addition to, or in place of, the external seal.

BRIEF DESCRIPTION OF THE DRAWINGS

The features and advantages of the present invention will be best appreciated upon reference to the following detailed description and the accompanying drawings, in which.

Figure 1:
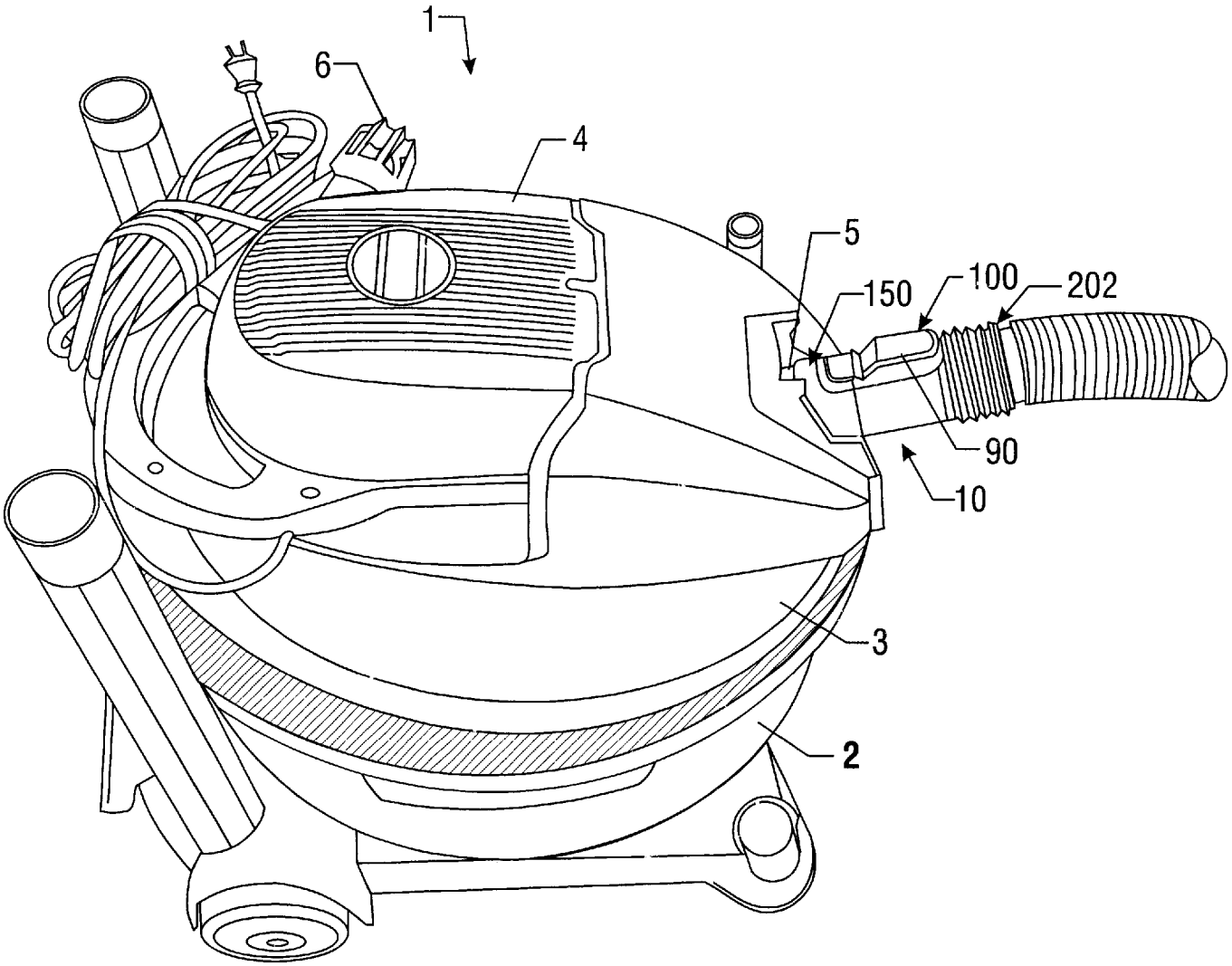
FIG. 1 shows a perspective view of a wet/dry vacuum cleaner connected to a hose utilizing an embodiment of a hose lock in accordance with the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the figures, FIG. 1 shows a perspective view of an embodiment of a hose lock according to the present invention employed on a wet/dry vac 1. As will be appreciated by one skilled in the art with the benefit of this disclosure, the hose lock can be utilized on any application requiring a leak-free seal and a quick connect/disconnect mechanism. As shown in FIG. 1, the wet/dry vac 1 comprises a collection tub 2 having a lid 3 and a powerhead assembly 4. The collection tub 2 and the lid 3 are preferably made of injection-molded plastic, such as polypropylene or the like, in accordance with conventional practice.

In accordance with conventional designs, an air inlet port 5 is defined in the lid 3 or, alternatively, may be defined in a side wall of the collection tub 2. The powerhead assembly 4 houses a motor and impeller assembly, and has defined therein an air exhaust or outlet port 6. A hose connection member 10 is locked onto a receptacle 150 that is mounted on the inlet port 5 of the wet/dry vac 1 to attach a hose 202 to the wet/dry vac 1. A locking handle 100 positively locks the connection member 10 to the wet/dry vac 1. The connecting receptacle 150 can be removably mounted to the wet/dry vac 1, or can be an integral part of it. The powerhead assembly 4 is operable to create a suction within the collection tub 2, such that debris and/or liquid is drawn in to the collection tub 2 through the hose 202, which is attached to the inlet port 5 via the connecting receptacle 150 and connection member 10.

Figure 2:
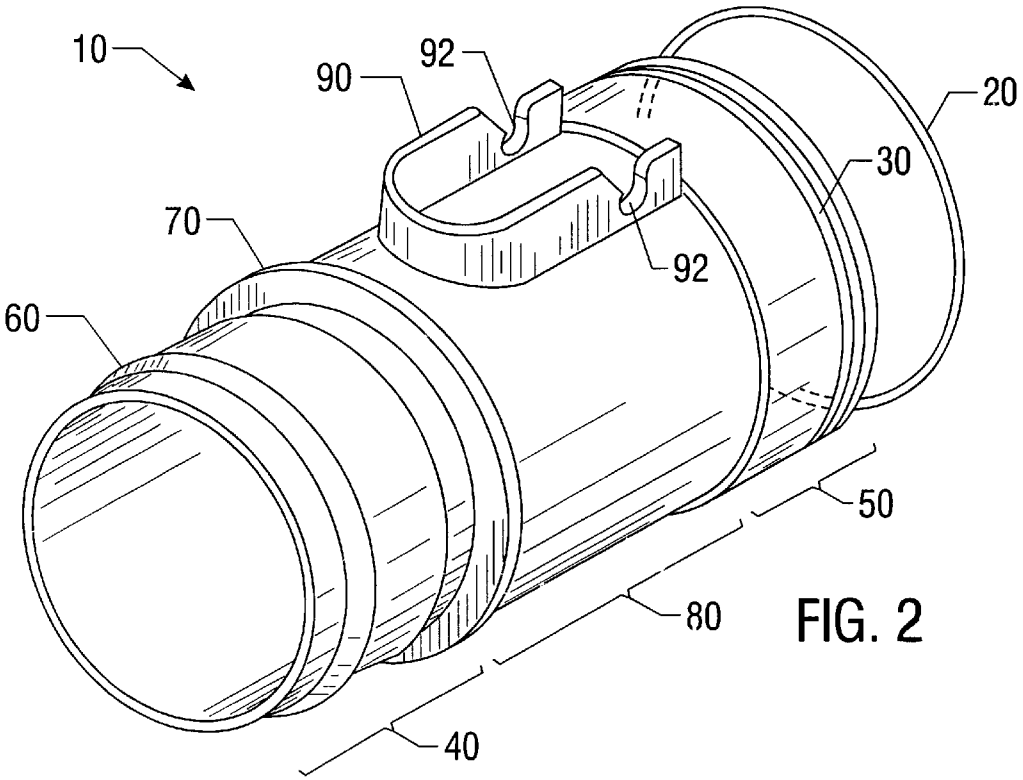
FIG. 2. shows a perspective view of an embodiment of a hose connector in accordance with the invention.

FIG. 2 shows a perspective view of an embodiment of the hose connection member 10 in accordance with the present invention. The hose connection member 10, may be made of plastic. The hose connection member 10 has a hose end 40, a main body 80, and a vac end 50. In the particular embodiment illustrated in FIG. 2, the vac end 50 has a larger outside diameter than the main body 80, and is adapted to have one or more sealing members removably mounted thereto. The inside diameter of the vac end 50 and the main body 80 is roughly uniform. The vac end 50 of the hose connection member 10 defines a groove 30, which is adapted to have seated therein the sealing member, which, in the embodiment illustrated in FIG. 2, comprises an O-ring 20.

Figure 7:
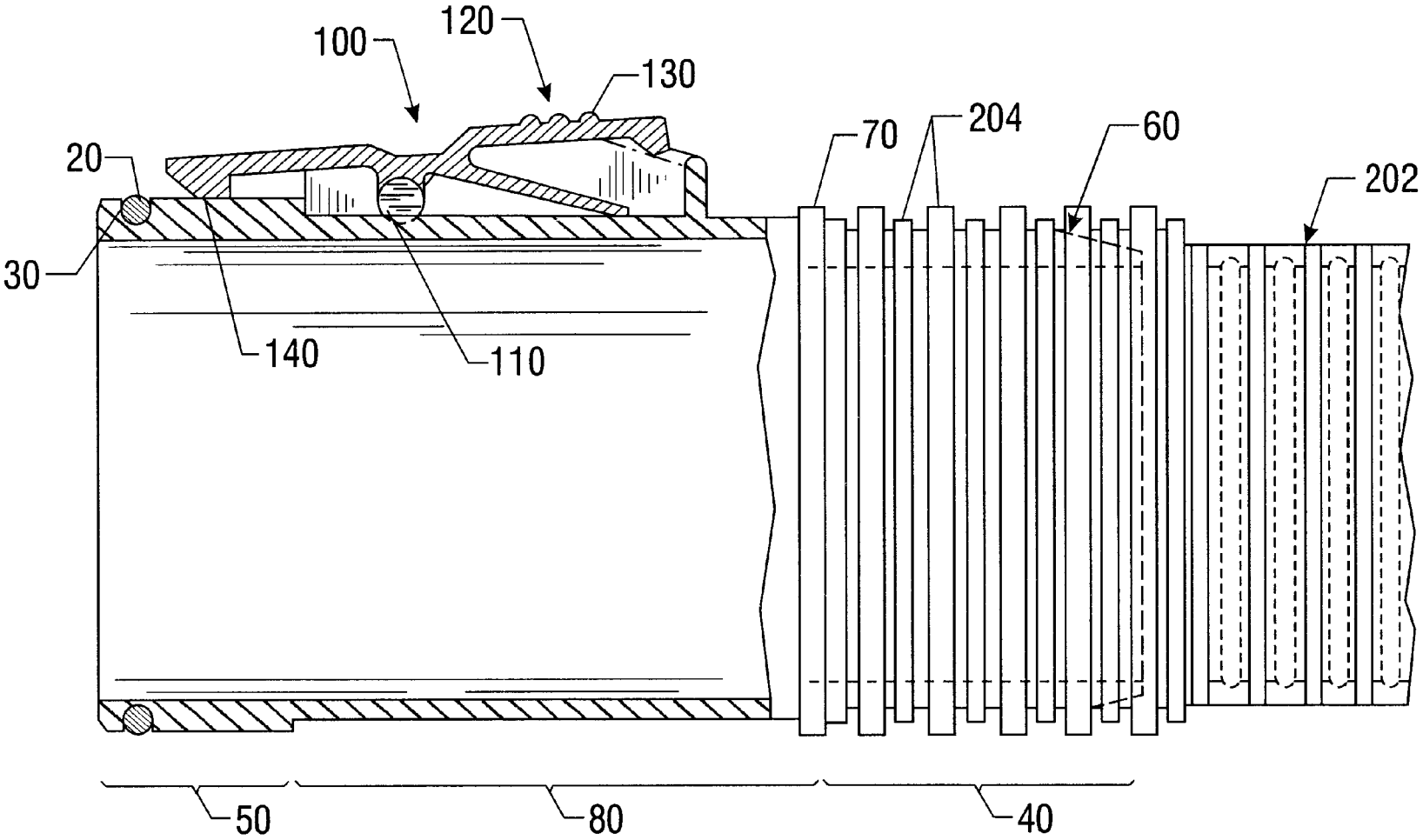
FIG. 7 shows a cross-sectional view of the hose connector of FIG. 2 having a hose attached to it.

To allow the insertion of the vac end 50 of the hose connection member 10 into the receptacle 150 (not shown in FIG. 2) to achieve a sealed connection, the diameter of the receptacle 150 should exceed that of the vac end 50, and the O-ring 20 should extend above the surface of the vac end 50, so that the O-ring 20 seals against an internal surface of the receptacle 150. In the embodiment illustrated in FIG. 2, the hose end 40 has a smaller circumference than the main body 80 of the hose connection member 10. The hose end 40 has a ridge 60 extending over and around the surface of the hose connection member 10 as shown in FIG. 2. FIG. 7 shows how the ridge 60 permits rotating and swiveling a hose 202 situated over the hose end 40 and maintains the hose 202 attached to the hose connection member 10. The hose end 40 also has a hose stopper 70 to prevent the hose 202 from sliding further over the hose connection member 10 as shown in FIG. 7.

Figure 10:
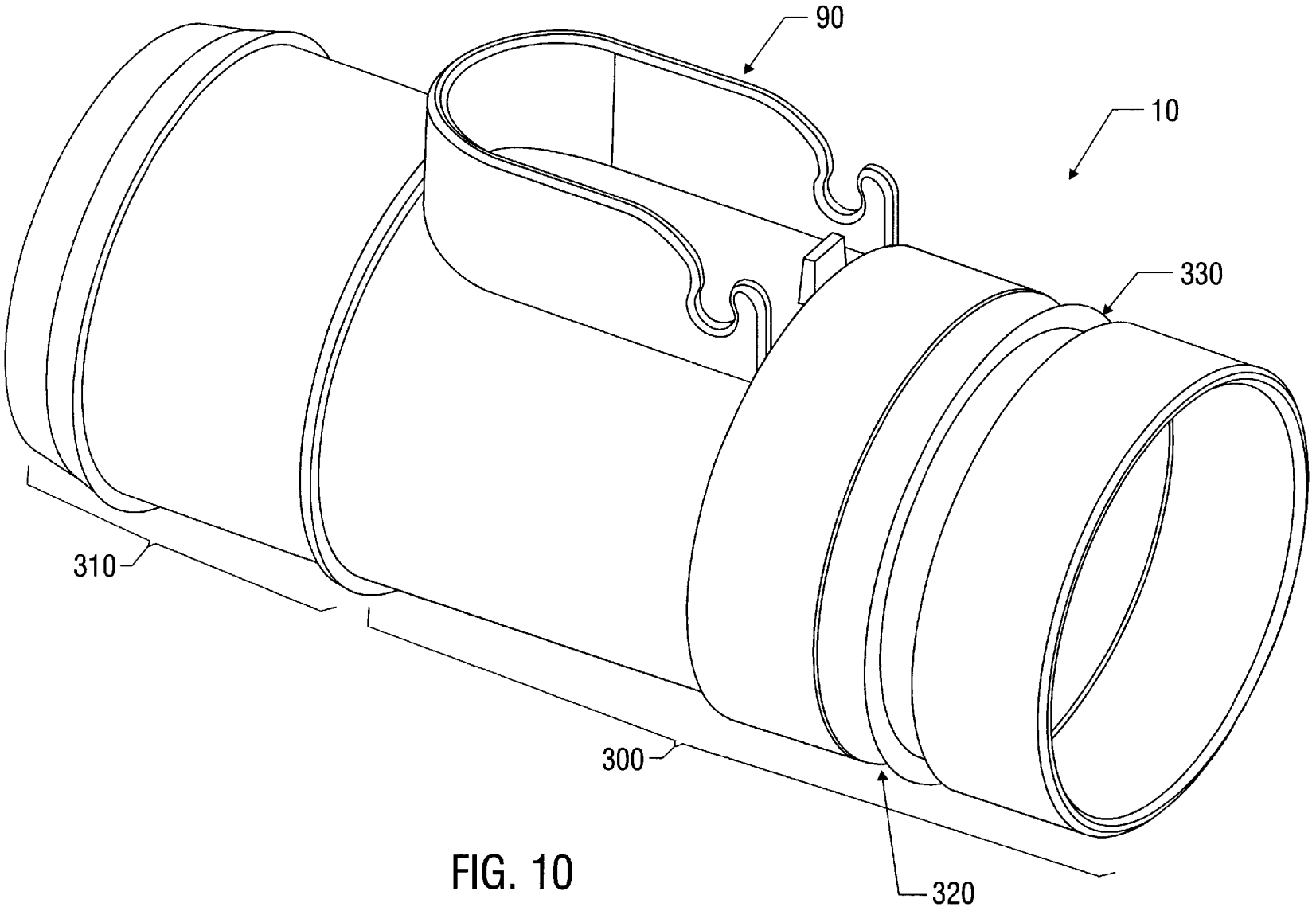
FIG. 10 shows a perspective view of another alternative embodiment of the present invention.

In an alternative embodiment, as shown in FIG. 10, O-ring 20 may be replaced by a seal member integrally formed in the vac end 50. Such an integrally formed seal member would have a diameter generally greater than the diameter of the vac end 50 so as to form a friction seal with an internal surface of the receptacle 150 when the vac end 50 is inserted therein. Moreover, the seal member may have a diameter greater than the inside diameter of the receptacle 150 and be formed in a manner to allow the seal member to deflect when the vac end 50 is inserted into the receptacle 150.

Figure 3:
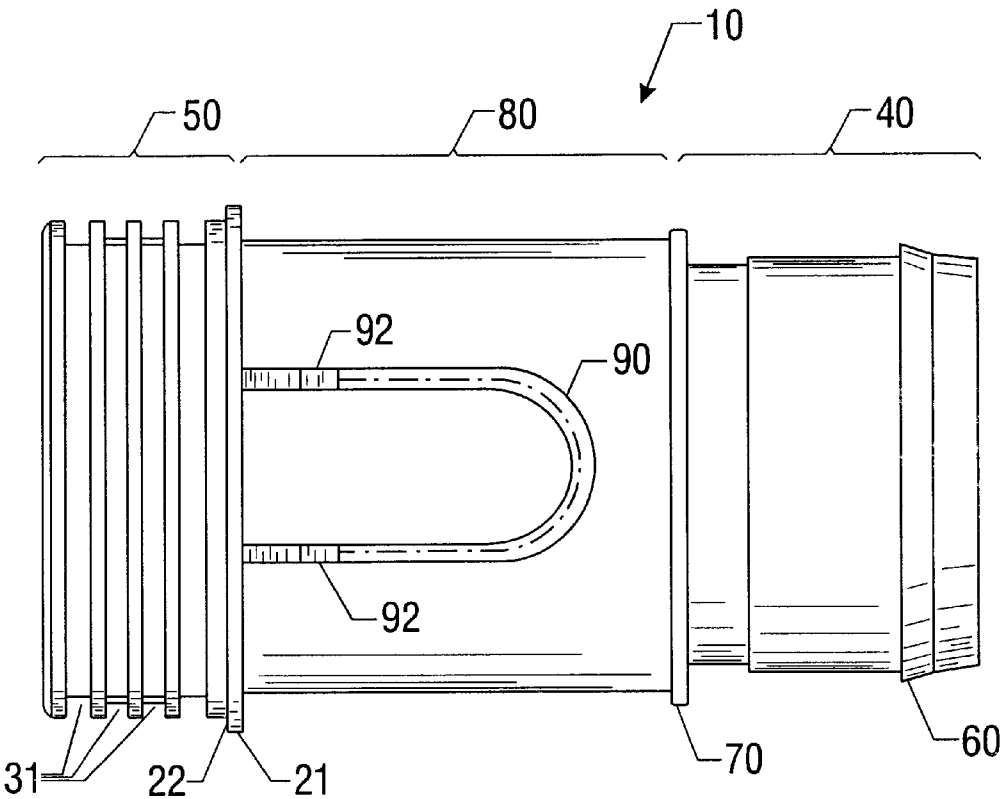
FIG. 3. shows a plan view of another embodiment of a hose connector in accordance with the invention.
Figure 4:
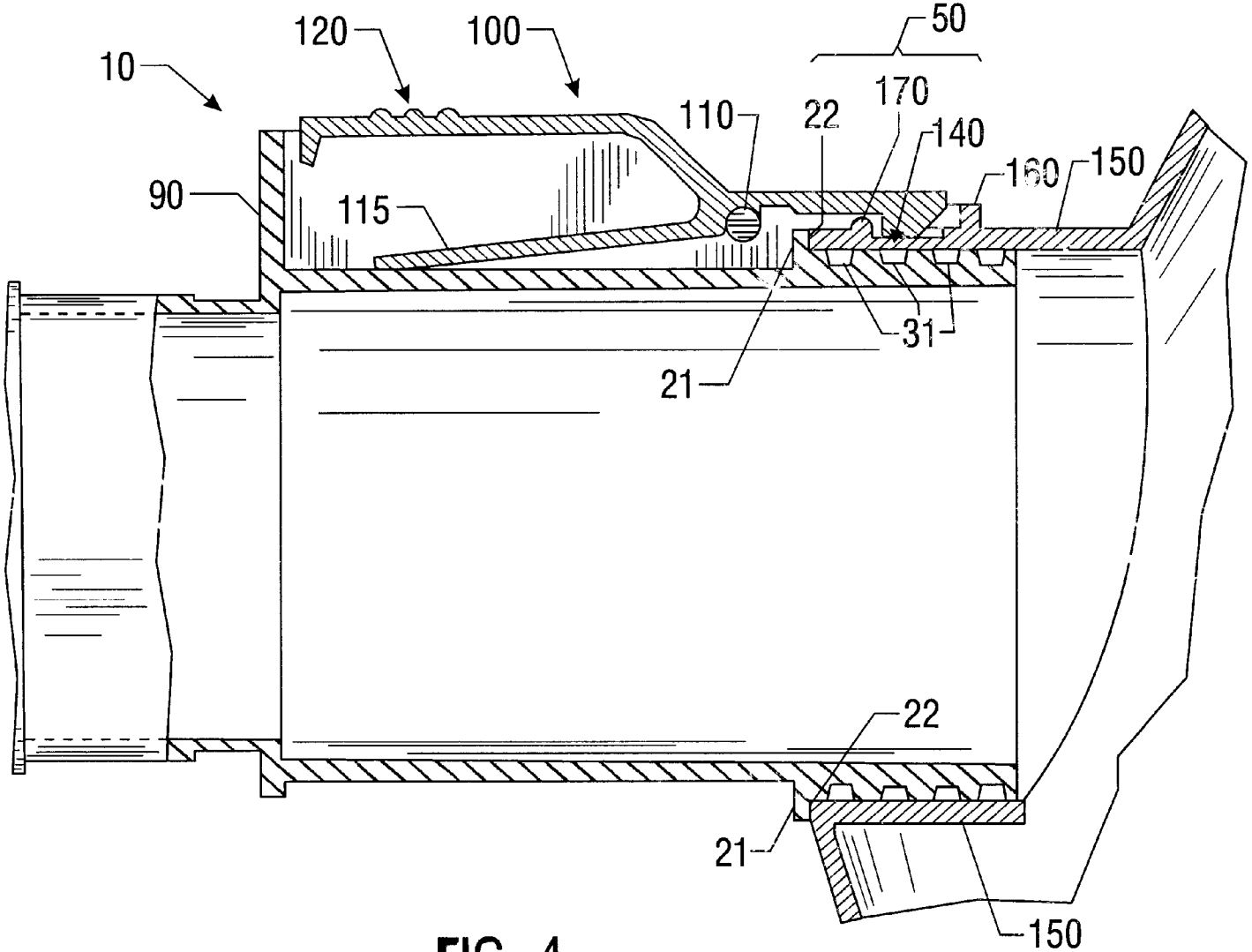
FIG. 4 shows a partial sectional view of the hose connector of FIG. 3 coupled to a receptacle.

An embodiment of the hose connection member 10 having an alternative configuration of the vac end 50 is illustrated in FIG. 3, in a plan view. In the embodiment illustrated in FIG. 3, the vac end 50 defines a plurality of grooves 31 therein, and a sealing ring 21 extends around the vac end 50. FIG. 4 is a partial section view of the vac end 50 of the hose connection member 40 inserted into the receptacle 150. The sealing ring 21 defines a sealing surface 22 that is generally perpendicular to the axis of the connection member 10. The sealing ring 21 is formed such that, when the vac end 50 is inserted into the receptacle 150, the sealing surface 22 abuts an external surface of the receptacle 150. When the wet/dry vac 1 is operated such that the power head assembly 4 creates a suction within the tub 2, the hose connection member 10 is sucked against the receptacle 150, causing the sealing surface 22 of the sealing ring 21 to seal against the external surface of the receptacle 150. This "self seal"

prevents air from entering the tub 2 other than through the hose and hose connection member 10.

In alternative embodiments, one or more O-rings 20, as illustrated in FIG. 2, may be seated in one or more of the grooves 31 to provide an internal, friction seal in addition to the external seal formed by the sealing surface 22 of the sealing ring 21.

Figure 5:
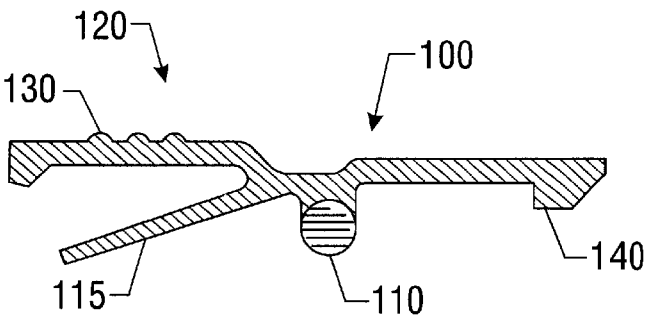
FIG. 5 shows a side elevation view of a locking handle for use with the hose connector of FIG. 2 and FIG. 3.

The hose connection member 10 defines a U-shaped channel 90 as shown in FIG. 2 and FIG. 3. FIG. 5 shows a side view of the locking handle 100 made to fit the U-shaped channel 90 shown in FIG. 2 and FIG. 3. The locking handle may be suitably made of hard sturdy material, such as plastic. The locking handle 100 has a pivot 110 that fits within two spring chambers 92 on the U-shaped channel 90. The locking handle 100 is pivotally attached to the connection member 10 by the spring chambers 92 holding the pivot 110. The locking handle 100 has a single tooth 140 to lock onto a connecting receptacle on the vac end 50 of the hose connection member 10. The locking handle 100 also has a pressing surface 120 having grip indentations 130 to prevent slippage when the pressing surface 120 is pushed, and a spring lever 115 extends below the pressing surface 120. When the locking handle 115 is pivotally attached to the connection member 10, the spring lever 115 presses against the connection member 10 to bias the tooth 140 down against the connection member 10.

Figure 6:
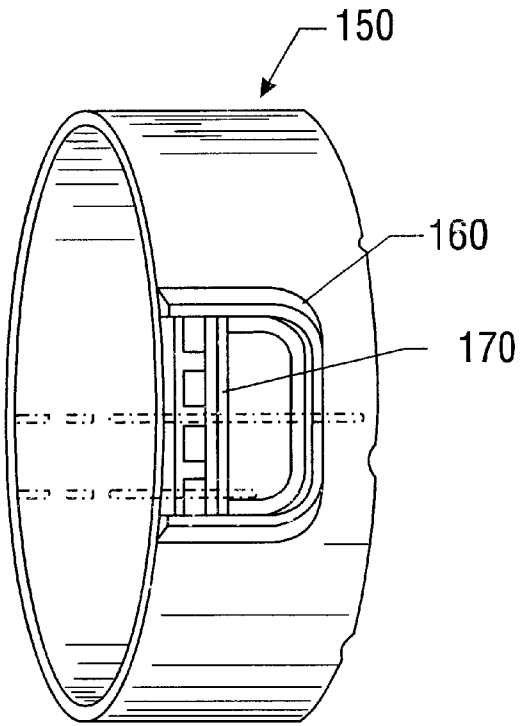
FIG. 6 shows a top view of the receiving piece for the hose connector of FIG. 2.

FIG. 6 shows an exemplary embodiment of one end of the connecting receptacle 150 that is adapted to have the vac end 50 of the connection member 10 inserted therein. The receptacle 150 has a U-shaped casing 160 to receive the locking handle 100 on the vac end 50 of the hose connection member 10. The U-shaped casing 160 has a single post 170 traversing it. The tooth 140 on the locking handle 100 is made to interlock with the post 170. Alternatively, a groove or indentation may be used to interlock with the tooth 140 on the locking handle 100. As will be appreciated by one skilled in the art having the benefit of this disclosure an alternative embodiment can have the locking handle 100 attached to the connecting receptacle 150, and the U-shaped casing 160 and post 170 located on the hose connection member 10.

FIG. 4 illustrates the manner by which the locking lever 100 couples the hose connection member 50 to the receptacle 150. To reach the illustrated position, the vac end 50 of the hose connection member 10 is inserted inside the connecting receptacle 150. As the vac end 50 is inserted in the connecting receptacle 150, the pressing surface 120 on the locking handle 100 is pressed to lift the single tooth 140 and permit insertion of the locking handle 100 end into the U-shaped casing 160. Once the vac end 50 is inserted in the connecting receptacle 150, the pressing surface 120 is released, and the spring lever 115 pushes the tooth 140 down, allowing the single tooth 140 to lock onto the post 170 traversing the U-shaped casing 160 as shown in FIG. 4. This action forms a positive lock between the hose connection member 10 and the connecting receptacle 150, preventing unwanted disconnections.

The embodiments of the vac end 50 disclosed herein allow for manufacturing variation in the placement of the various parts (the locking handle 100, the post 170, the tooth 140, etc.) involved in locking and sealing the connection member 10 to the receptacle 150. The locking handle 100 keeps the connection together and prevents accidental disconnection, while the sealing ring 21 self seals against the outer surface of the receptacle 150 when the wet/dry vac is operated to prevent leakage. Thus, it is not necessary for the vac end 50 to mate with the inside of the receptacle 150 to form a friction or interference seal.

In embodiments employing one or more O-rings 20 (as illustrated in FIG. 2), the O-ring 20 would interact with the inner surface of the receptacle 150 to provide a sealed connection, rather than relying on a direct friction seal between the vac end 50 and the inside of the receptacle 150. Further, the O-ring 20 is not required to interact with any particular location along the inside surface of the receptacle 150.

As will be appreciated by one skilled in the art having the benefit of this disclosure, the sealing ring 20 shown in FIG. 2 may be positioned in alternative locations. For example, the O-ring 20 may be mounted within the inner wall of the vac end 50 of the connection member 10. In this case, the connecting receptacle 150 will be of a smaller diameter than the vac end 50 of the connection member 10. Alternatively, the O-ring 20 may be mounted on the connecting receptacle 150 rather than on the connection member 10.

As shown in FIG. 7, according to one embodiment of the invention, the hose end 40 of the hose connection member 10 is inserted inside a hose 202. The hose 202 is generally flexible and composed of sequential rings 204 with alternating diameters at the connecting end. The ridge 60 on the hose end 40 of the hose connection member 10 locks onto one of the sequential rings 204 on the hose 202 to prevent the hose connection member 10 from slipping out of the hose 202. The hose connection member 10 is prevented from further entering into the hose 202 by a decrease in hose 202 diameter as shown in FIG. 7.

Figure 8:
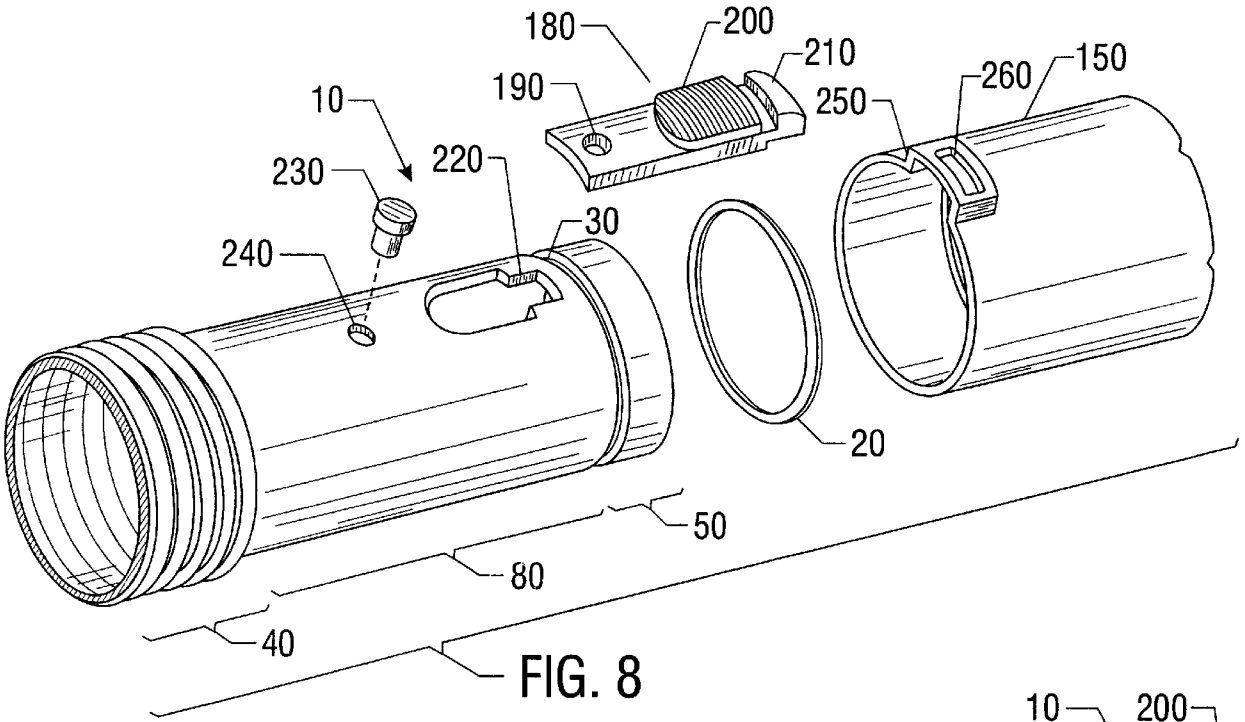
FIG. 8 shows a perspective view of an alternative embodiment of the present invention.

FIG. 8 shows a perspective view of an alternative embodiment of the present invention. The exemplary embodiment of FIG. 8 differs from the embodiment disclosed in conjunction with FIGS. 2–6 with respect to the locking mechanism. According to the embodiment of FIG. 8, a connecting handle 180, having a circular orifice 190, a grooved press base 200, and a cusp 210, is placed inside the main body 80 of the hose connection member 10. The main body 80 of the hose connection member 10 has an aperture 220 from where the grooved press base 200 can protrude and extend above the surface of the main body 80 of the hose connection member 10. The connecting handle 180 is attached to the main body 80 of the connection member 10 by inserting a pin 230 through a perforation 240 on the main body 80 and through the circular orifice 190 on the connecting handle 180. The connecting handle 180 should be long enough for the cusp 210 to extend past the end of the seal side 50 of the hose connection member 10.

According to the embodiment of FIG. 8, the connecting receptacle 150 has an elevated housing 250 adapted to receive the cusp 210 on the connecting handle 180. The elevated housing 250 also defines a recess 260 to interlock with the cusp 210 on the connecting handle 180. The hose end 40 is essentially the same in both embodiments described. The sealing ring 20 is seated over the groove 30 on the vac end 50 as in the embodiment.

Figure 9:
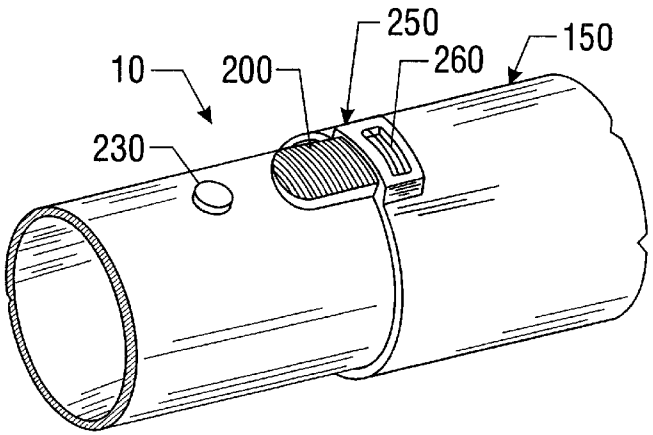
FIG. 9 shows a perspective view of the alternative embodiment of FIG. 8 in the connected and locked position.

FIG. 9 shows a perspective view of a hose connection member 10 connected to the connecting receptacle 150 according to the embodiment of FIG. 8. When the hose connection member 10 is connected to the connecting receptacle 150 as shown in FIG. 9, the seal ring 20 seated on the groove 30 on the hose connection member 10, makes an interference fit with the inner walls of the connecting receptacle 150. To lock the connection the grooved press base 200 on the connecting handle 180 is pressed as the seal end 50 of the hose connection member 10 is slipped into the connecting receptacle 150. The cusp 210 should be aligned with the elevated housing 250. Once the cusp 210 is below the recess 260 in the elevated housing 250, and the pressure is released from the grooved press base 200, the cusp 210 interlocks with the recess 260.

Figure 11:
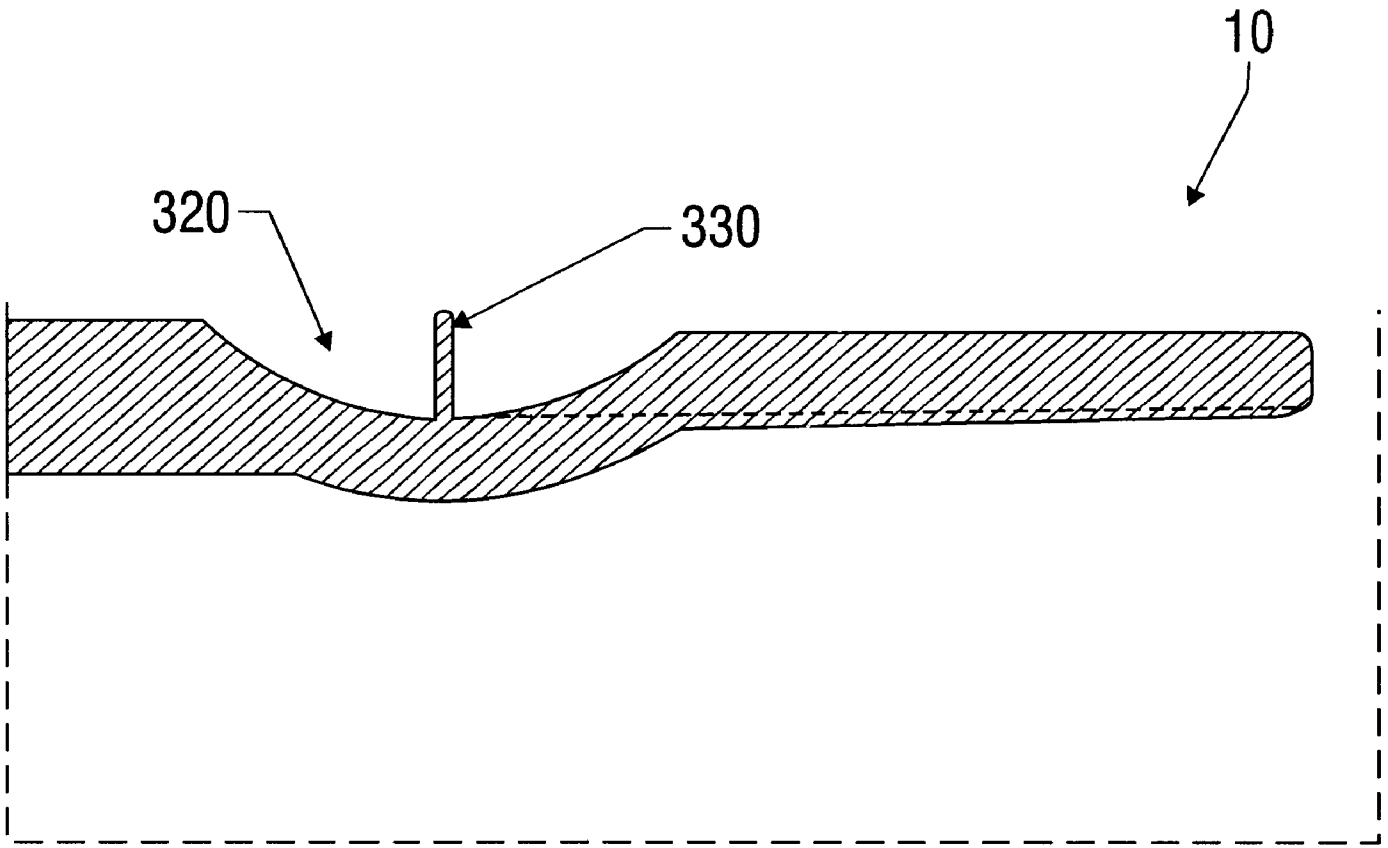
FIG. 11 shows a close-up, cross-sectional view of the alternative embodiment of FIG. 10.

FIG. 10 shows a perspective view of another alternative embodiment of the present invention. The exemplary embodiment of FIG. 10 differs from the embodiment disclosed in conjunction with FIGS. 2–9 with respect to the sealing member. According to the embodiment of FIG. 10, a connection member 10 is shown having a first end 300 and second end 310. First end 300 has depression 320 around its outer surface, and a thin, annular rib 330 integrally formed around connection member 10 inside of depression 320. Rib 330 protrudes outward from depression 320 such that it extends slightly beyond the surface of connection member 10. A magnified view of this is shown in FIG. 11.

According to this embodiment, connection member 10 is inserted into receptacle 150 while creating a proper seal, without the need for a separate sealing member such as an O-ring. When connection member 10 is inserted into receptacle 150, rib 330 is bent backward by its contact with the inner surface of receptacle 150 such that a proper seal is formed. Depression 320, in which rib 330 is set, provides clearance for rib 330 to flex when inserted into receptacle 150. Thus, rib 330 is deformed by the inner surface of receptacle 150, forming a self-energizing seal when a vacuum is created inside of the vacuum cleaner. The configuration can also be reversed, with rib 330 being integrally formed into the inner surface of receptacle 150 and a seal created when connection member 10 is inserted into receptacle 150.

Rib 330 is preferably constructed from a polypropylene material, although other materials can be used which have a suitable flexural modulus to allow a proper seal to be maintained, and which allow rib 330 to return to its original shape when disengaged from receptacle 150. This embodiment of the connecting member, having an integrated sealing member, has several benefits. First, this embodiment provides a one-piece construction of a connection member, which is easier to handle and work with than a multi-piece assembly. Secondly, cost savings can be realized by integrating the function of separate parts into a single molded part.

Figure 12:
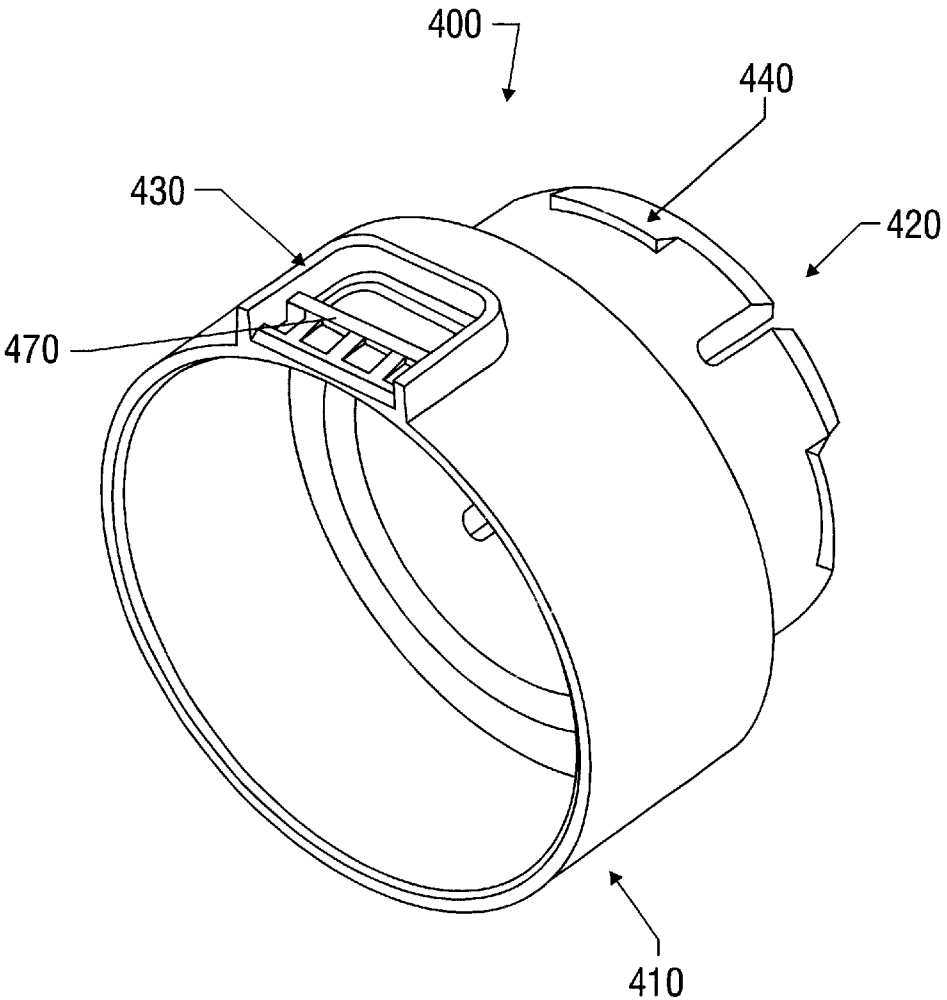
FIG. 12 shows a perspective view of an adapter utilizing an embodiment of a hose lock in accordance with the invention.
Figure 14:
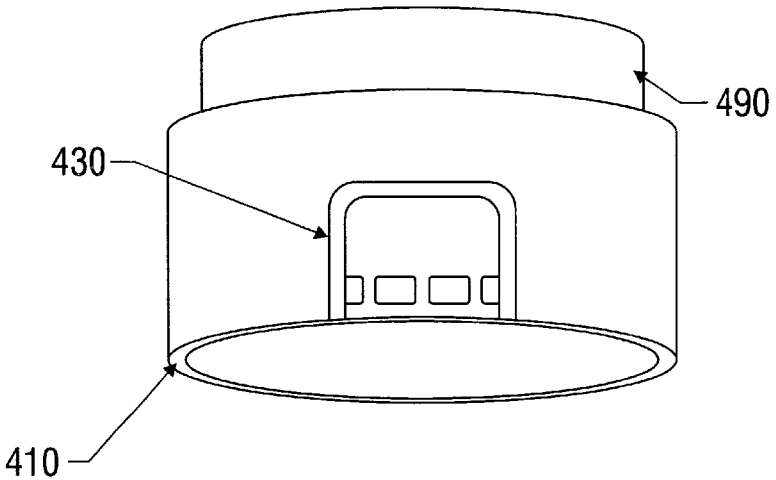
FIG. 14 shows a partial top view of a wet/dry vacuum utilizing an embodiment of a hose lock in accordance with the invention.

FIG. 12 shows a perspective view of another embodiment of the invention, adapter 400, which can be used to permanently convert a wet/dry vacuum having a friction-based hose connecting receptacle 490 (as used in the prior art, and shown in FIG. 14) to a vacuum able to receive a hose having a locking attachment, as disclosed herein. Adapter 400 has two ends, a connecting end 410 and an adapting end 420. Connecting end 410 has a U-shaped casing 430 to receive the locking handle 100 on the vacuum end 50 of connection member 10 (not shown). The U-shaped casing 430 has a single post 470 traversing it. The tooth 140 on the locking handle 100 of connection member 10 is made to interlock with the post 470. Alternatively, a groove or indentation may be used to interlock with the tooth 140 on the locking handle 100. As will be appreciated by one skilled in the art having the benefit of this disclosure, an alternative embodiment of adapter 400 can have the locking handle 100 attached to the connecting end 410 of the adapter 400, with the U-shaped casing 160 and post 170 located on the connection member 10. Also, the locking mechanisms need not be of the particular configuration disclosed herein.

Figure 13:
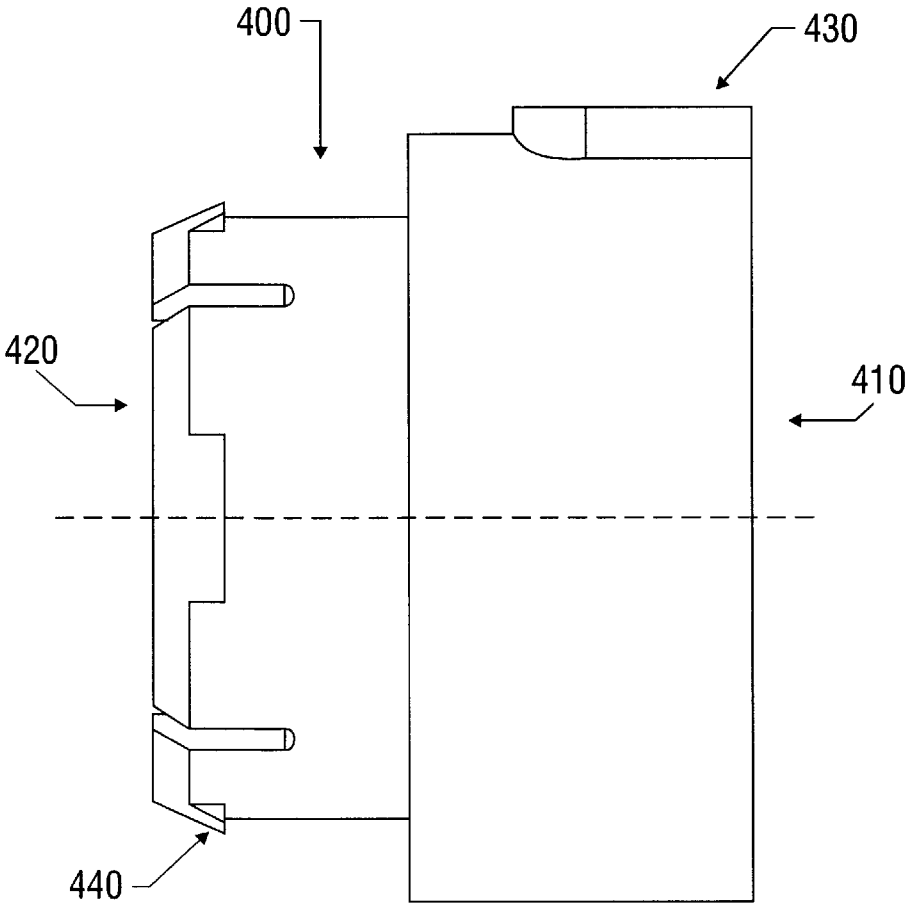
FIG. 13 shows a side view of an adapter utilizing an embodiment of a hose lock in accordance with the invention.

Adapting end 420 of adapter 400, also shown in FIG. 13, is configured so as to permanently lock adapter 100 into place onto a friction-based vacuum connecting receptacle 490. Flaps 440 at the end of adapting side 420 operate to latch adapter 400 onto the end of a friction-based vacuum connecting receptacle 490 when adapting side 420 of adapter 400 is inserted into the connecting receptacle. This thus gives a consumer the advantage of upgrading an older, friction-fit wet/dry vacuum without the expense of purchasing a new unit having a hose lock feature as disclosed herein.

Adapter 400 may be made of plastic, and may be designed to fit all embodiments of receptacle 150. One skilled in the art having the benefit of this disclosure will appreciate that an alternative embodiment of adapter 400 can be configured to attach to the vacuum end of a friction based hose connection member such that a friction-based hose can be adapted for use with a wet/dry vacuum having a locking attachment as disclosed herein.

Thus, the present invention provides a hose lock, and adapter, that quickly and simply locks a hose to a receptacle mounted on an article such as a wet/dry vac to prevent inadvertent disconnections, while providing a seal to prevent air leaks. The above description of exemplary embodiments of the invention are made by way of example and not for purposes of limitation. Many variations may be made to the embodiments and methods disclosed herein without departing from the scope and spirit of the present invention.

What is claimed is:

1. A device for connecting a hose to a wet/dry vacuum, comprising:

a connection member having first and second ends, the second end defining a diameter and the first end adapted to be coupled to the hose, the connection member including a sealing member integrally formed around said second end and defining a diameter larger than the diameter of said second end;

a receptacle attachable to a wet/dry vacuum and comprising an inner surface, the receptacle adapted to receive the second end of the connection member such that the sealing member interacts with the inner surface of the receptacle to form a seal; and a first locking element mounted on the second end of the connection member and a second locking element mounted on the receptacle, the first and second locking elements adapted to engage in a positive locking relationship to secure the connection member to the receptacle.

2. A device as defined in claim 1, wherein the connection member defines a depression into which said sealing member is integrally formed.

3. A device as defined in claim 2, wherein the sealing member comprises a rib that is oriented generally perpendicular to a longitudinal axis of the connection member and that defines a sealing surface, the sealing surface adapted to seat against an internal surface of the receptacle.

4. A device as defined in claim 1, wherein the receptacle further comprises an internal surface adapted to engage the sealing member.

5. A wet/dry vacuum, comprising:

a collection tub;

a lid coupled to the collection tub;

a powerhead assembly operable to create a suction within the collection tub;

an inlet port disposed in one of the lid or the collection tub;

a receptacle able to be coupled to the inlet port and comprising an, inner surface;

a hose;

a connection member having first and second ends, the second end defining a diameter and the first end adapted to be coupled to the hose, the connection member including a sealing member integrally formed around said second end and defining a diameter larger than the diameter of said second end;

said receptacle adapted to receive the second end of the connection member such that the sealing member interacts with the inner surface of the receptacle to form a seal; and a first locking element mounted on the second end of the connection member and a second locking element mounted on the receptacle, the first and second locking elements adapted to engage in a positive locking relationship to secure the connection member to the receptacle.

6. The wet/dry vacuum of claim 5, wherein the connection member defines a depression in which said sealing member is integrally mounted.

7. A device as defined in claim 6, wherein the sealing member comprises a rib that is oriented generally perpendicular to a longitudinal axis of the connection member and that defines a sealing surface, the sealing surface adapted to seal against an internal surface of the receptacle.

8. The wet/dry vacuum of claim 5 wherein the receptacle further comprises an internal surface against which the sealing member is mounted.

9. A device for connecting a hose to a wet/dry vacuum, comprising:

a connection member having first and second ends, the first end adapted to be coupled to the hose, and comprising a sealing member integrally formed around said second end, the connection member defining a depression into which the sealing member is integrally formed;

a receptacle attachable to a wet/dry vacuum and comprising an inner surface, the receptacle adapted to receive the second end of the connection member such that the sealing member interacts with the inner surface of the receptacle to form a seal; and a first locking element mounted on the second end of the connection member and a second locking element mounted on the receptacle, the first and second locking elements adapted to engage in a positive locking relationship to secure the connection member to the receptacle.

10. A device as defined in claim 9, wherein the sealing member comprises a rib that is oriented generally perpendicular to a longitudinal axis of the connection member and that defines a sealing surface, the sealing surface adapted to seal against an internal surface of the receptacle.

11. A wet/dry vacuum, comprising:

a collection tub;

a lid coupled to the collection tub;

a powerhead assembly operable to create a suction within the collection tub;

an inlet port disposed in one of the lid or the collection tub;

a receptacle able to be coupled to the inlet port and comprising an inner surface;

a hose;

a connection member having first and second ends, the first end adapted to be coupled to the hose, and comprising a sealing member integrally formed around said second end, the connection member defining a depression into which the sealing member is integrally formed;

said receptacle adapted to receive the second end of the connection member such that the sealing member interacts with the inner surface of the receptacle to form a seal; and a first locking element mounted on the second end of the connection member and a second locking element mounted on the receptacle, the first and second looking elements adapted to engage in a positive locking relationship to secure the connection member to the receptacle.

12. A device as defined in claim 11, wherein the sealing member comprises a rib that is oriented generally perpendicular to a longitudinal axis of the connection member and that defines a sealing surface, the sealing surface adapted to seal against an internal surface of the receptacle.

* * * * *